US007311599B2

(12) United States Patent
Knapp

(10) Patent No.: US 7,311,599 B2
(45) Date of Patent: Dec. 25, 2007

(54) INSTANT-WIN LOTTERY TICKET ALLOWING KEYLESS VALIDATION AND METHOD FOR VALIDATING SAME

(75) Inventor: Russ Knapp, Downingtown, PA (US)

(73) Assignee: Gtech Rhode Island Corporation, Providence, RI (US)

( * ) Notice: Subject to any disclaimer, the term of this patent is extended or adjusted under 35 U.S.C. 154(b) by 618 days.

(21) Appl. No.: 10/211,153

(22) Filed: Aug. 2, 2002

(65) Prior Publication Data

US 2004/0023711 A1 Feb. 5, 2004

(51) Int. Cl.
*A63D 15/20* (2006.01)

(52) U.S. Cl. ..... 463/17

(58) Field of Classification Search ..... 463/16–20, 463/29–30; 273/269, 138.1, 139; 283/72, 283/100, 101, 103, 901, 903, 102, 462.01, 283/94; 235/100, 903, 375; 364/412
See application file for complete search history.

(56) References Cited

U.S. PATENT DOCUMENTS 4,630,844 A * 12/1986 Troy et al. ..... 283/67
4,725,079 A 2/1988 Koza et al.
5,317,135 A * 5/1994 Finocchio ..... 463/17
5,471,039 A 11/1995 Irwin, Jr. et al.
5,621,200 A 4/1997 Irwin Jr. et al.
5,791,990 A * 8/1998 Schroeder et al. ..... 463/17
5,818,019 A 10/1998 Irwin Jr. et al.
5,835,576 A 11/1998 Katz
5,887,906 A 3/1999 Sultan
6,053,408 A 4/2000 Stoner
6,234,477 B1 5/2001 Scrymgeour et al.
6,237,913 B1 * 5/2001 Kamille ..... 273/139
6,270,406 B1 * 8/2001 Sultan ..... 463/17
6,308,991 B1 * 10/2001 Royer ..... 283/102
6,379,742 B1 4/2002 Behm et al.
6,435,408 B1 8/2002 Irwin Jr. et al.
6,491,215 B1 12/2002 Irwin Jr. et al.
6,736,324 B2 5/2004 Behm et al.
6,776,337 B2 8/2004 Irwin Jr. et al.

(Continued)

FOREIGN PATENT DOCUMENTS

EP 1308191 5/2003

(Continued)

OTHER PUBLICATIONS

International Search Report for International Application No. PCT/IB03/03447.

*Primary Examiner*—Robert E. Pezzuto
(74) *Attorney, Agent, or Firm*—Kenyon & Kenyon LLP

(57) ABSTRACT

A game ticket is disclosed. The game ticket includes a substrate, a game play area located on the substrate, and a first machine-readable code located on the substrate. The machine-readable code includes a first piece of authentication information. A second machine-readable code is located on the substrate. The second machine-readable code includes a second piece of authentication information. A removable opaque covering applied to the substrate conceals the game play area and the second machine-readable code. The first machine-readable code is not concealed by the removable opaque covering. Both the first piece of authentication information and the second piece of authentication information are required for authenticating the game ticket. A method and apparatus for using the game ticket is also disclosed.

34 Claims, 10 Drawing Sheets

U.S. PATENT DOCUMENTS

| | | | |
|---|---|---|---|
| 7,059,514 | B1 | 6/2006 | Peters et al. |
| 7,073,720 | B2 | 7/2006 | Behm et al. |
| 2002/0072404 | A1 | 6/2002 | Gerow |
| 2005/0167922 | A1 | 8/2005 | Finocchio |
| 2005/0181858 | A1* | 8/2005 | Caro et al. ..... 463/17 |

FOREIGN PATENT DOCUMENTS

| | | | |
|---|---|---|---|
| GB | 2171054 | A | 8/1986 |

* cited by examiner

INSTANT-WIN LOTTERY TICKET ALLOWING KEYLESS VALIDATION AND METHOD FOR VALIDATING SAME

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

BACKGROUND INFORMATION

Lottery game tickets are frequently sold in retail establishments such as convenience stores, liquor stores, and the like. These and other establishments selling lottery tickets are sensitive to the costs of counter space used, and labor required in the sale and redemption of lottery tickets Some lottery customers do not want to wait for a weekly or daily drawing. These customers may purchase "instant-win" lottery tickets. Such tickets may also involve games, such as lotto, battleship, bingo, or other games that increase customer interest and enjoyment in the purchase of such tickets. Instant-win lottery tickets are generally sold to retailers in pre-printed books or bundles. A pre-printed ticket may have a printed indica or message indicating the ticket is a winner and/or the prize amount, as well as human or machine-readable codes for authenticating winning tickets. These indica, messages, and codes may be hidden, e.g., with a peel-off or scratch-off coating. Commonly, whether an instant-win ticket is a winner is predetermined prior to the sale of the ticket.

One cost that retailers are particularly sensitive to is the cost of redeeming tickets. Retailers do not want to spend excessive amounts of time dealing with redemptions of tickets that are not actually winners. Also retailers want to minimize the amount of time spent authenticating tickets. At the same time lottery providers want to insure that lotteries are protected from fraud, including fraud by retailers. Accordingly, efficient and reliable approaches to ticket validation are desirable.

To allow authentication of winning instant-win tickets, conventional instant-win tickets may include a numeric code that is keyed in by a cashier when the ticket is tendered for redemption. For example, U.S. Pat. No. 5,317,135 to Finocchio describes a method and apparatus for validating instant-win tickets. This numeric code may be used to authenticate the ticket, e.g., as a key in a public key encryption system or as an index to a ticket database. Some other proposed lottery systems use machine readable authentication information in order to speed the process of validating a ticket. Machine readable information avoids the need to have a cashier or attendant manually key in authentication information. These proposed lottery systems have included tickets where all of the authentication information is hidden when the ticket is sold, e.g., by hiding a machine-readable code under the scratch-off coating found on a typical instant ticket. However, to improve authentication and fraud control, it may be useful to make some of the authentication information available prior to the sale of a ticket, and thus prior to the removal of the concealing scratch-off or other layer.

DETAILED DESCRIPTION OF EXAMPLE EMBODIMENTS

Example Ticket

Figure 1:
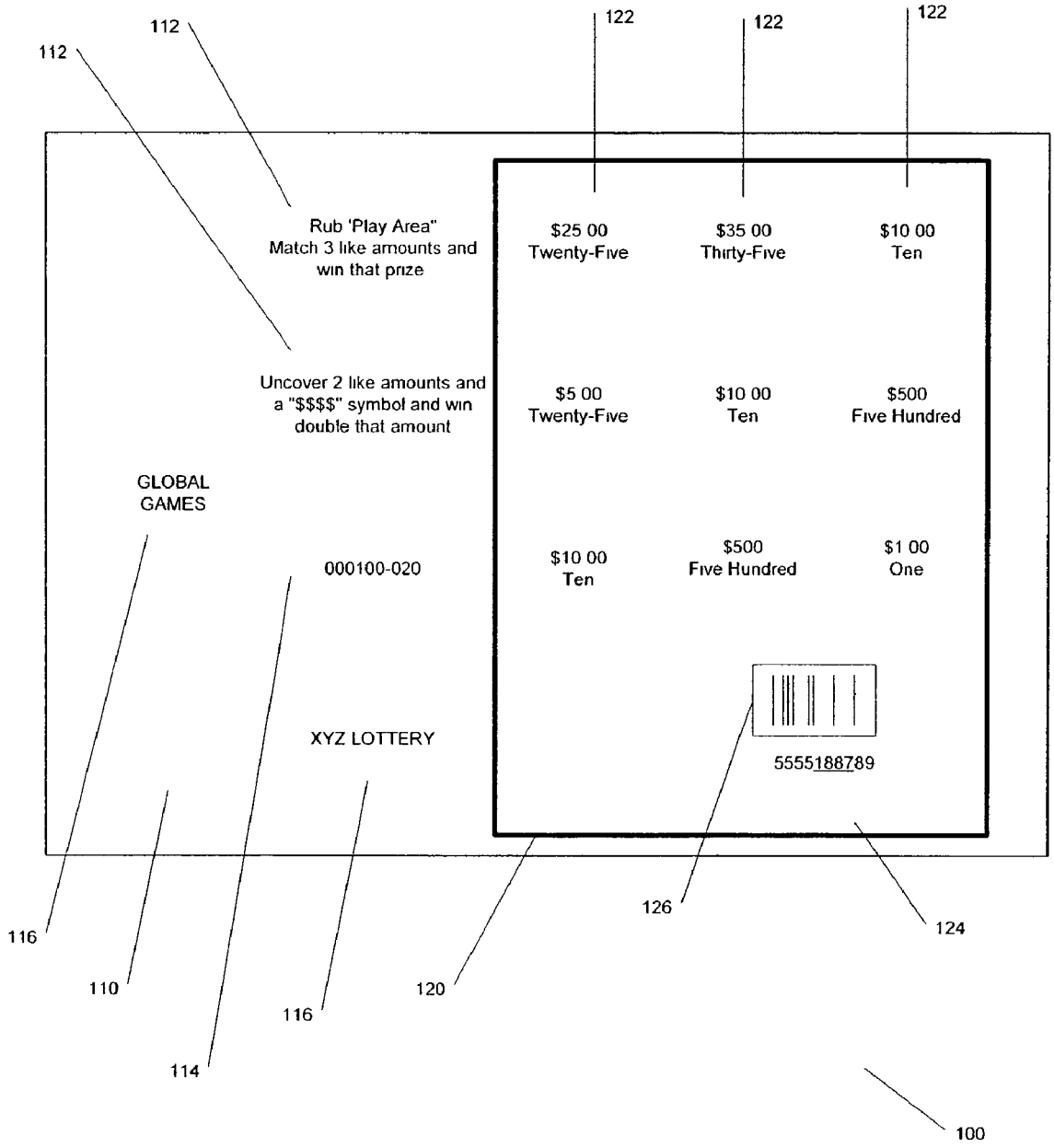
FIG. 1 illustrates an example lottery ticket, according to an example embodiment of the present invention.

FIG. 1 illustrates an example lottery ticket, according to an example embodiment of the present invention. The example lottery ticket may be for an instant-win lottery game. Instant-win games differ from pooled drawing games, where a lottery ticket represents a chance in a drawing to be held at some later time for a pooled prize or prizes. Rather, in an instant-win game, whether the ticket is a winner is determined at or before the time the ticket is purchased, although whether the ticket is actually a winner may be concealed from the buyer and seller. Instant-win games may include "extended play" features such as games printed on the ticket, e.g., bingo or number matching. These features may increase the enjoyment and interest level of purchasers of such tickets, causing them to buy tickets in greater numbers or more frequently. It will be appreciated that the example ticket may also be used for other forms of games, e.g., for promotional games such as those used in direct mail or at fast food restaurants.

The example lottery ticket 100 illustrated in FIG. 1 may be located on a substrate, e.g., a printable substrate such as paper, card stock, plastic, or various laminates. Information may be found on both sides of the example lottery ticket. The obverse side of the ticket shown in FIG. 1 may include a non-play area 110 and a play area 120.

The non-play area 110 may include information not directly involved in the play of the "extended play" game provided on the ticket. Located on the non-play area may be instructions 112 for playing the extended play game, or for the use and/or redemption of the ticket. The non-play area 110 may include a card series identifier 114 that may identify the game and type of ticket. The card series identifier 114 may be used by the retailer in inventory control and/or other point of sale purposes. The non-play area may also include logos or advertising information 116, e.g., identifying the provider of the game such as a state lottery.

The play area 120 may include game information 122. The game information may be examined by a ticket purchaser in light of the rules of the game to determine whether the ticket is a winner, and if so the winning amount. The play area may include a numeric code 124. More digits may be provided for greater security. The numeric code may include part of the information needed to authenticate the ticket when the ticket is redeemed. Portions of the numeric code may be highlighted, by underlining them as illustrated, or by other approaches, e.g., placing a black box around or a colored box over the numbers to be highlighted. A machine-readable version of the numeric code 126 may also be located on the play area. The machine-readable version of the numeric code 126 may be a bar code, e.g., a stacked linear bar code or two-dimensional bar code. A standard 2 of 5 or other standard bar code may be employed. It will be appreciated that other forms of machine-readable information may be included on the ticket, in place of the bar codes, e.g., magnetic strips or smart card capability. It will also be appreciated that the machine readable code 126 may also include other information, e.g., a checking code that may provide sufficient information to identify whether the ticket is a winner without providing sufficient information to authenticate the ticket. Such a check code may be used at a checking station that may be provided to allow customers to test whether they have winning tickets. Other information may also be provided, e.g., the identifier of the pack the ticket comes from.

Figure 2:
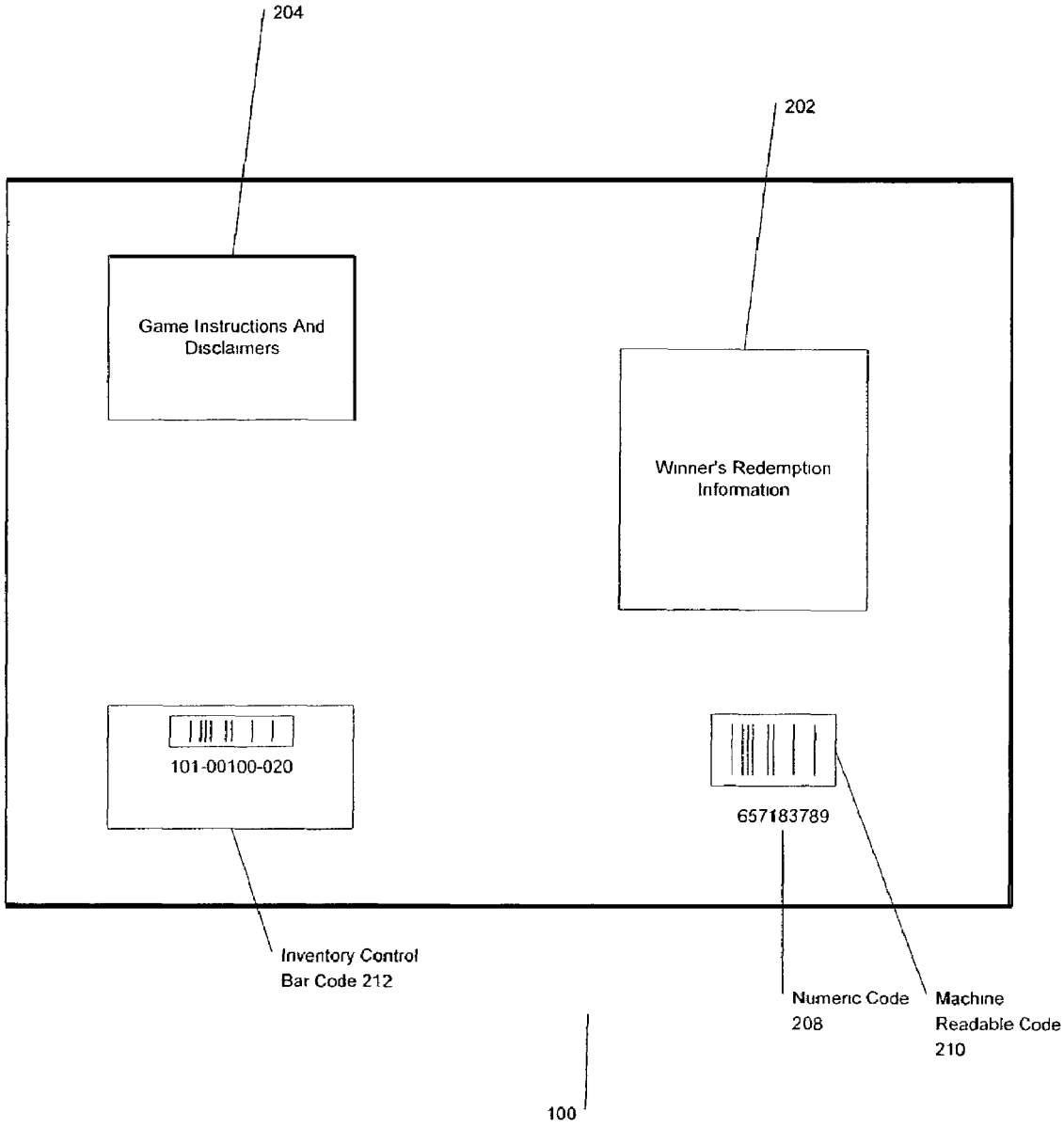
FIG. 2 illustrates the reverse side of an example lottery ticket, according to an example embodiment of the present invention.

FIG. 2 illustrates the reverse side of an example lottery ticket 100, according to an example embodiment of the present invention. The reverse side of the example lottery ticket 100 may include a form 202 for the collection of redemption information. This redemption information may include the signature of the person redeeming the ticket as well as their name, address, telephone number, and age. Depending on the jurisdiction, collection of this information may be required by regulators or may be useful for other purposes, e.g., constructing a direct marketing database. The reverse side of the example lottery ticket 100 may also include game instructions and disclaimers 204, e.g., required legal notices, information about where and how to redeem the ticket, a ticket expiration date, etc.

The reverse side of the example lottery ticket may also include a numeric code 208 and a machine-readable version of the numeric code 210. The numeric code 208 and machine-readable numeric code 210 may include the same information. The numeric code may include authentication information that is required for the authentication of a winning ticket, or for the authentication of winning tickets of greater than a certain amount. More digits may be provided for greater security. Information in the numeric code 208 may also be used to activate the ticket before it is sold. Requiring activation of tickets before sale may make fraud and/or ticket theft more difficult, although it does increase the amount of resources required to sell tickets. The numeric code 208 may also contain other information, e.g., an identification of the lottery selling the game, an identification of the particular game, etc.

The reverse side of the example lottery ticket 100 may also include an inventory control number and/or bar code 212. The information contained in the inventory control number may be used by a retailer to track ticket sales and purchases, but not for ticket authentication. The format for the inventory control bar code may match other standard inventory control codes used by retailers. For example the inventory control number may be a standard UPC code.

Figure 3:
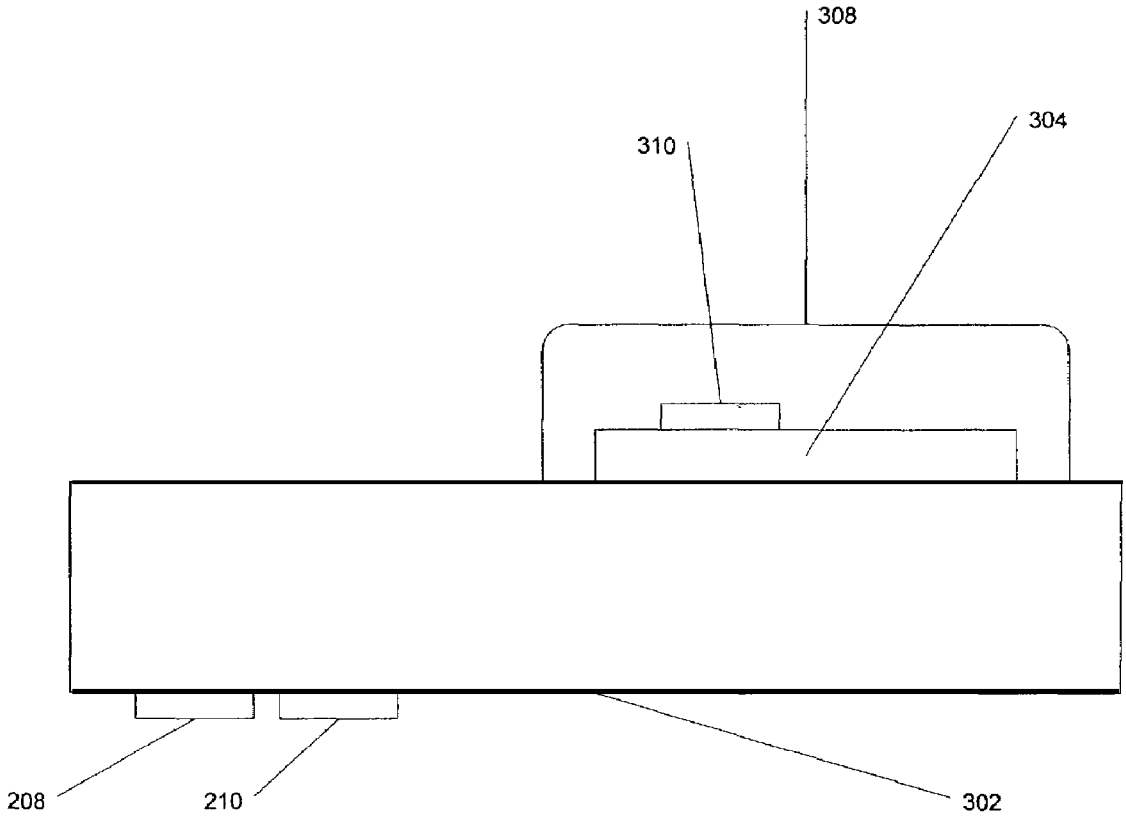
FIG. 3 illustrates an example cross-sectional view of an example lottery ticket, according to an example embodiment of the present invention.

FIG. 3 illustrates an example cross-sectional view of an example lottery ticket, according to an example embodiment of the present invention. The example lottery ticket 100 may include a substrate 302. The game play area 304 may be located on one side of the substrate 302. A machine-readable code 310 may be located on the game play area. The machine-readable code 310 may contain authentication information needed for the authentication of a winning ticket. Other information, discussed above, may also be located on the game play area. A removable opaque layer 308 may cover the game play area, including any information located on the game play area, such as the code 310. Printed tickets with removable scratch-off layers are available from many sources, e.g., Pollard Banknote Ltd. of Winnipeg, Canada, Scientific Games Corporation of New York, N.Y., Oberthur Gaming Technologies of Montreal, Canada and Creative Games International, Inc. of Plant City, Fla.

Information may also be located on the reverse side of the example lottery ticket 100. For example, a second numeric code 208 and machine readable version of this code 210 may be located on the reverse side of 100. The numeric code 208 and machine readable code 210 may contain the same information. They may both contain authentication information needed to authenticate a winning ticket before redemption.

It will be appreciated that the various items located on the card may be re-arranged. For example, the information located in the game play area under the opaque layer may be intentionally moved to random locations under the concealing layer in order to prevent "pin-pricking", a form of fraud where pin-pricks are used to determine what is located under the concealing layer.

It will be appreciated that all the information displayed on the card, and in particular the authentication codes, need not be printed, but may be included on the card using other approaches, e.g., using a machine-readable magnetic stripe or smart code.

Figure 4:
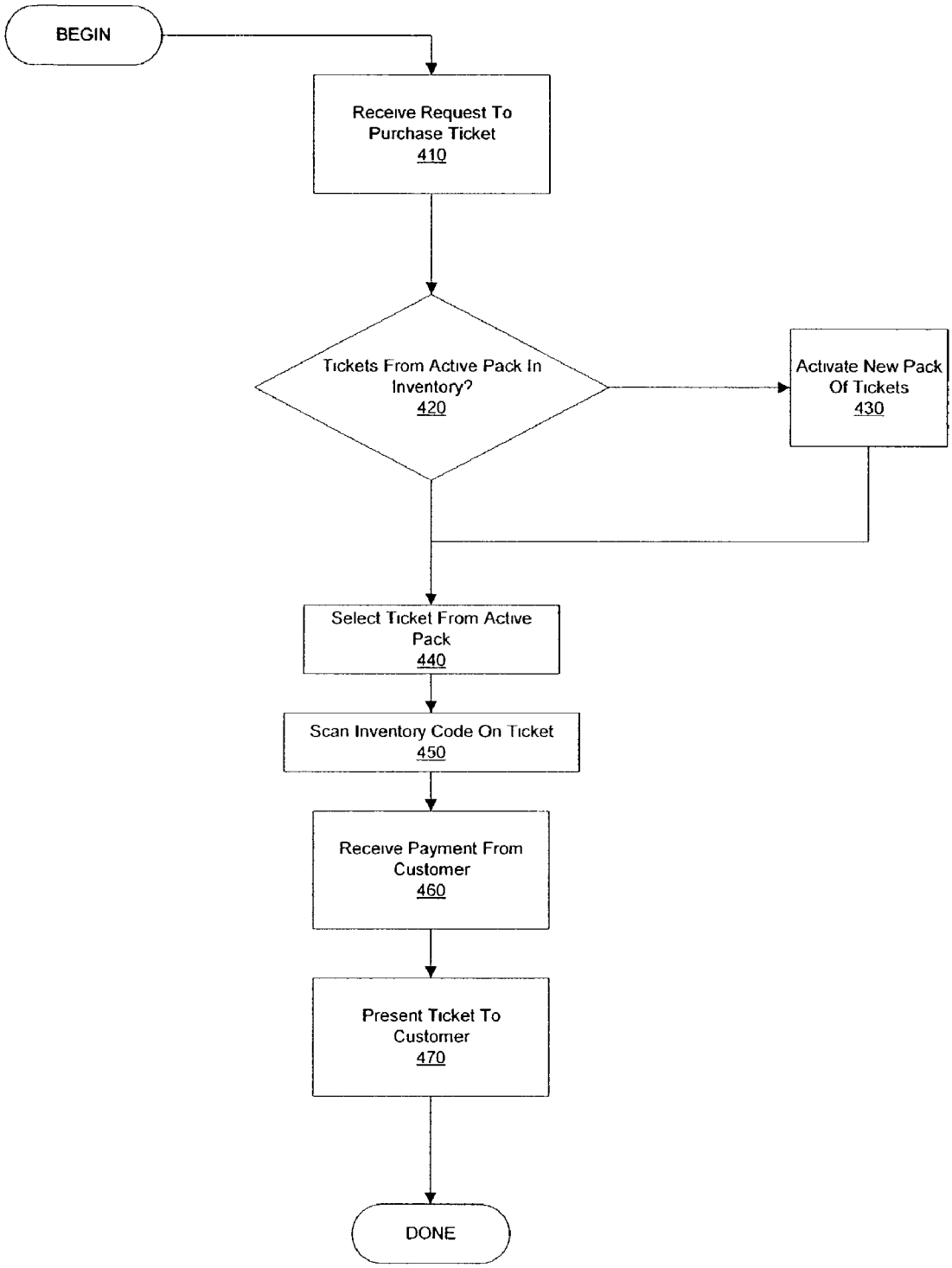
FIG. 4 illustrates an example procedure for the sale of a lottery ticket, according to an example embodiment of the present invention.

FIG. 4 illustrates an example procedure for the sale of a lottery ticket, according to an example embodiment of the present invention. It will be appreciated that the example procedure may be completed using a point of sale terminal operated by a cashier or attendant, or may be completed by an automated point of sale terminal, e.g. a vending machine.

In 410, a request to purchase a lottery ticket may be received. For example, the request may result from a customer asking a cashier to purchase a ticket, who then keys the request in to the point of sale terminal. Alternatively, the customer may enter a request directly into a machine, e.g., by using a touch keypad, a keyboard, or pressing buttons.

In 420, whether there are tickets available from an active pack of tickets may be determined. Presently, retailers receive instant-win lottery tickets in packs or books. For security and auditing purposes, a pack of tickets may need to be activated before any tickets of the pack are sold. If there are not presently tickets from an active pack, the example procedure may continues with 430. If active tickets are available the example procedure may continue with 440. In 430, a new pack of tickets may be activated, e.g., by entering appropriate codes. The activation of a pack of tickets may result in information about the activation being communicated to a central game control server. This may be accomplished by keying in a code provided on a pack of tickets, or scanning a bar code provided for that purpose on a ticket pack. Alternatively, a request to activate a pack of tickets may be provided automatically when a request to activate a first ticket in a pack is made. The activation of a pack of tickets may result in information about the activation being communicated to a central game control server, e.g., an identity code for the pack, information indicating when and/or where the pack was activated. Activation of a pack may also require a retailer to provide a password or take other actions related to security and fraud control. Additional security and audit measures may also be provided, e.g., the identity of organizations to whom ticket packs are provided may be recorded, and the tickets may only be activated by the same organization that is recorded as having purchased a particular ticket pack.

In 440, a ticket may be selected from an active pack of tickets. This may be accomplished by a cashier, or the tickets may be automatically dispensed by an attended point of sale terminal with a dispensing capability, or the tickets may be dispensed by an unattended ticket vending machine.

In 450, an inventory code on the ticket may be scanned. This scanning may be similar to the sale of other products, and may be used to record the sale of a ticket in a retailer's point of sale system, and to provide information to a point of sale terminal for generating a sales receipt.

In 460, payment may be received from a customer for the ticket. Payment may be in any form accepted by the retailer for lottery purchases, e.g., cash, credit or debit card, check.

In 470, the ticket may be presented to the customer. This completes the example ticket sale procedure.

Figure 5:
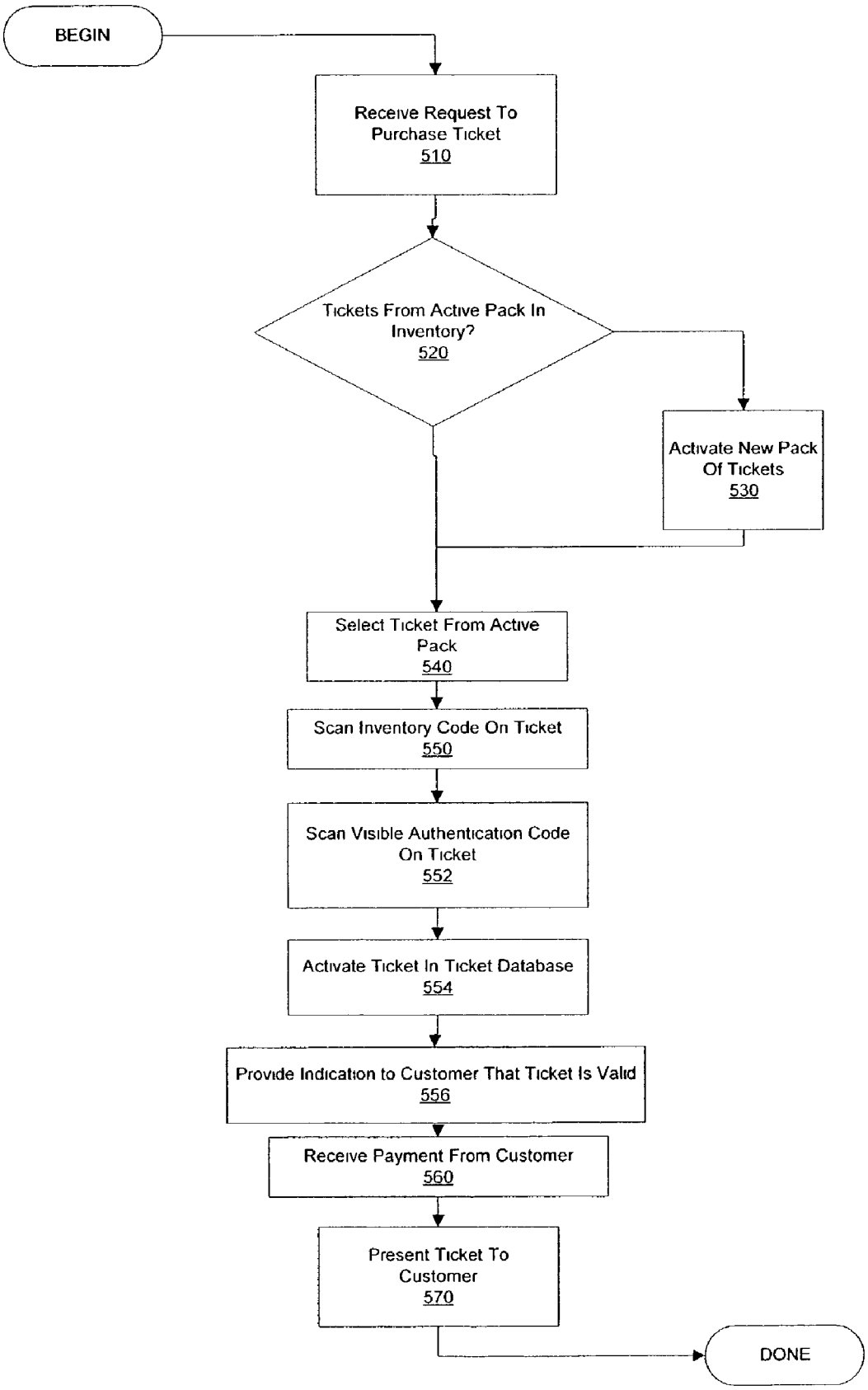
FIG. 5 illustrates an alternative example procedure for sale and activation of a ticket, according to an alternative example embodiment of the present invention.

It will be appreciated that alternative procedures may be used for the sale and activation of tickets. FIG. 5 illustrates an alternative example procedure for sale and activation of a ticket, according to an alternative example embodiment of the present invention. The alternative example procedure may be generally similar to the example procedure previously illustrated in FIG. 4, with the follow additions. 510, 520 and 530 may be identical to 410, 420, and 430, respectively, in the example procedure illustrated in FIG. 4.

In the alternative example activation procedure, individual tickets may be activated before they are sold. A ticket from an active pack may be selected and the inventory code is scanned, e.g., in 540 and 550, in a manner similar to that previously described for the example activation procedure. In 552 a machine-readable authentication code on the ticket may be scanned, e.g., by using a bar code reader or other input device. The machine-readable authentication code is not concealed by a scratch-off or other concealing layer. The machine-readable authentication code may contain sufficient authentication information to uniquely track and record the ticket, and confirm that the ticket is an authentic ticket, but does not contain sufficient information to determine if the ticket is a winning ticket.

In 554, the machine-readable authentication code or other information derived from the code read in 552 (e.g., selected digits) may be transmitted to a lottery server or other ticket control database. The ticket control database may be co-located with the lottery point of sale terminal, or may be a central server connected to many different point of sale terminals over a network. An entry in a ticket database for the selected ticket may be used to verify that the ticket is authentic, and to record that the ticket has been sold. The ticket database entry may be marked to include the date, time, and location of the sale, e.g., for use in auditing. A message that the ticket has been successfully activated may be transmitted back to the ticket point of sale terminal. If the activation code is unique for each ticket, a re-used or re-sold may be detected and flagged, and appropriate message that the ticket is invalid may be generated.

In 556, an indication may be provided that the ticket is valid and activated. For example an audible tone, green light, or message may be provided by the point of sale terminal. This may be desirable, because some of the most common types of fraud in instant-win ticket games are perpetrated by people working in the retail sale of tickets. For example, an unscrupulous retailer or ticket agent may attempt to identify winning tickets, and retain them, while selling the losing tickets to customers. Providing an indication that a ticket is valid and has just been activated may insure that a pre-checked losing ticket is not being re-sold to a customer. It will be appreciated that alternative messages may be provided for when the ticket is invalid. Having a unique code for each ticket, e.g., the machine readable code which is not located under the removable opaque coating, will facilitate the identification of attempts to re-sell losing tickets. When an attempt to activate a ticket with a unique identifier that has been previously activated is detected, this likely indicates some sort of problem, e.g., error and/or fraud is occurring.

In 560 payment may be received from the customer. In 570 the activated ticket may be tendered to the customer.

It will be appreciated that other procedures for ticket sale and activation may be employed, e.g., the example procedure may be re-ordered and additional security checks and features may be added.

It will be appreciated that the example and alternative example ticket sale and activation procedures illustrated above may be provided as a series of instructions adapted to be executed by a processor. These instruction may be provided on an article of manufacture, e.g., a disk, a tape, a memory, a CD-ROM, etc.

Figure 6:
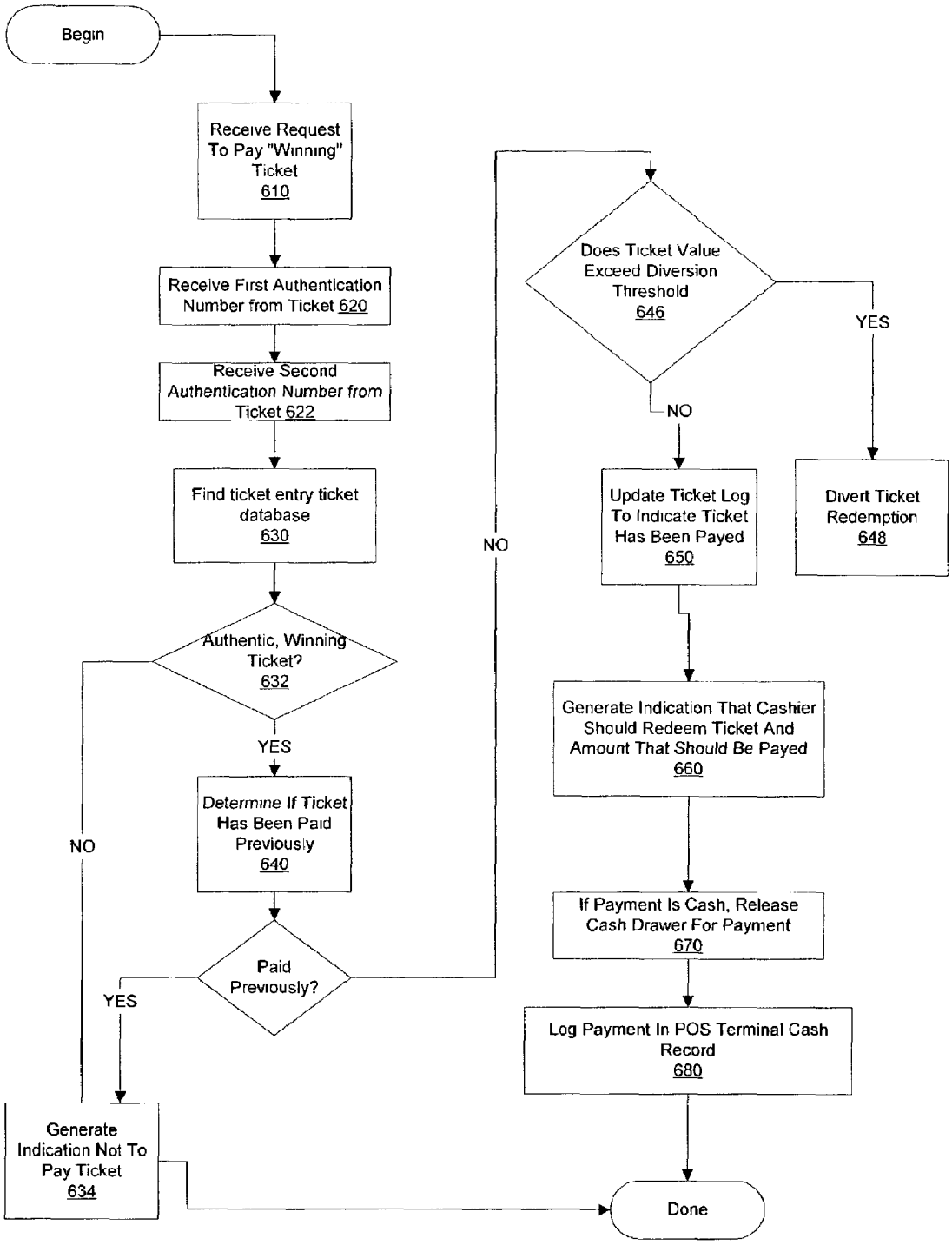
FIG. 6 illustrates an example redemption procedure for instant-win lottery tickets, according to an example embodiment of the present invention.

FIG. 6 illustrates an example validation procedure for instant-win lottery tickets, according to an example embodiment of the present invention. In 610, a request to pay a "winning" ticket may be received. For example, a customer may tender an instant-win ticket to a cashier at a lottery point of sale terminal, or the ticket may be inserted into an automated vending machine that is configured to redeem tickets.

In 620, a piece of authentication information from the ticket may be received. A machine readable code, not originally found under the removable coating on a scratch-off instant-win lottery game may be scanned, e.g., using a bar code scanner. The scanning may be performed by a ticket agent, e.g., with a scanning wand, or by an automated point of sale terminal that includes a scanning device. The code read from the ticket may be the first piece of authentication information, or it may contain the first authentication information, e.g., as a subset of the digits or other predetermined function. This may be the same code originally used to activate the ticket, if pre-sale activation is employed. Alternatively, both activation and authentication codes may be separate, either as two separate machine readable codes, or as different parts of a single machine readable codes, e.g., different digit positions in a single code.

In 622, a second piece of authentication information may be received from the tendered ticket. A second machine readable code, originally located under the removable coating on a scratch-off instant-win lottery game may be scanned, e.g., using a bar code scanner. Because the machine readable code located under the removable opaque layer should only be readable after the ticket has been played, the code read from the ticket may be the second piece of authentication information by itself, or it may contain the second piece of authentication information, e.g., as a subset of the digits or other predetermined function.

In 630, information about the tendered ticket may be retrieved. This may be accomplished, in some applications, by processing the information and looking up information contained in the point of sale terminal, e.g., in a prize pool.

Alternatively, 630 may also involve transmitting a predetermined function of the scanned authentication numbers to a central lottery control or database system, e.g., the entirety of both codes, a subset of each code, a sum of the codes, a concatenation of the codes, etc. The central lottery control or database system may then process the authentication codes, e.g., by checking corresponding entries in a ticket database. The central lottery control system may include a database of all tickets in the game, whether they are winners, whether the amount they win, whether the tickets have been activated, etc. The authentication information from the tendered ticket may be used as a key to look up an appropriate entry in the ticket database. It will be appreciated that more than two pieces of authentication information may be employed in alternative implementations of the example authentication procedure.

In 632, whether the ticket is an authentic winning ticket may be determined. For example, a ticket without an entry in the database would not be redeemable. Also the ticket's entry in the database may indicate the ticket is a losing ticket. If the ticket is not an authentic winning ticket the example procedure may continue with 634. Otherwise the example procedure may continue with 640.

In 634, a message may be transmitted to the point of sale terminal that the ticket is not a winning ticket. The point of sale ticket may generate a message to indicate the ticket is not a winning ticket, e.g., by sending a message to a screen visible to the operator or to the customer. It may also be useful to generate instructions for how to determine a winning ticket from the game ticket, because it may be likely that the customer has incorrectly interpreted the ticket and does not understand how to identify a winning ticket.

In 640, information on whether the ticket has been previously redeemed may be looked up in the ticket database. It may also be useful to verify the ticket has been activated, if activation of tickets prior to sale is required in the particular implementation of the example procedure. If the ticket has been previously redeemed an appropriate message may be generated, and the example procedure may continue with 634, sending a message to the point of sale terminal and/or operator not to redeem the ticket. If the ticket has not been previously redeemed the example procedure may continue with 646.

In 646, tickets of greater than a certain value may be diverted. For example tickets redeemable for prizes greater than $500 may be diverted. Tickets may also be diverted for other reasons, e.g., tickets flagged for random audits, or tickets that have been flagged by security procedures as suspicious for other reasons, e.g., tickets from packs which have been identified as lost or stolen. If the redemption is diverted, the example procedure may continue with 648. Otherwise the example procedure may continue with 650.

In 648, ticket redemption may be diverted. For example, a message may be sent to the point of sale terminal that indicates the customer should bring the ticket to a lottery service center for validation and redemption. Such procedures are conventionally used in many lottery and other gaming applications. Large tickets can then be authenticated in person. In addition to improving security, diverting large tickets also has the advantage of reducing the likelihood that a retailer will be unable to redeem a large ticket because they do not have sufficient cash on hand.

In 650, the ticket database may be updated to indicate the ticket has been redeemed. Conventional locking procedures may be used to insure atomic redemption transactions, prevent problems with lost connections or computer crashes. Such procedures protect customers from being unable to redeem winning tickets after such failures have occurred, and may also be included to prevent fraudulent redemption schemes.

In 660, an indication that the ticket should be redeemed may be generated, e.g., by the central lottery computer sending a message to the lottery point of sale terminal. This signal may cause an automated point of sale terminal to dispense cash for the winning ticket, or may cause a message to be displayed in a conventional lottery point of sale terminal that indicates the attendant should pay the winning ticket.

In 670 and 680, conventional cash management procedures may be followed, e.g., by opening a cash drawer and logging the payment made. Alternatively, correct amounts may automatically be dispensed and logged, e.g., from a automated vending machine type application.

It will be appreciated that other operations may be included in the example procedure, and that the operations of the example procedure may be re-ordered. For example, additional promotional activities may be incorporated into the procedure, such as offering to allow the customer to purchase new tickets or receive store credit instead of receiving cash for a winning ticket. Multi-level security procedures may be employed, with an initial screening at the terminal for small amounts, and a central database screening used only for larger amounts. Diverted tickets, because they are of great interest to anyone interested in fraud because of the high value, may be excluded from the database. Rather, a diverted ticket may simply have a diversion instruction on it, and not be redeemable electronically, and the identities of the diverted tickets may be stored in a special high-security list not normally accessible to remote terminals. It will be appreciated that many other variations to the example authentication procedure may also be employed.

It will be appreciated that the example validation procedure illustrated above may be provided as a series of instructions adapted to be executed by a processor. These instruction may be provided on an article of manufacture, e.g., a disk, a tape, a memory, a CD-ROM, etc.

Figure 7:
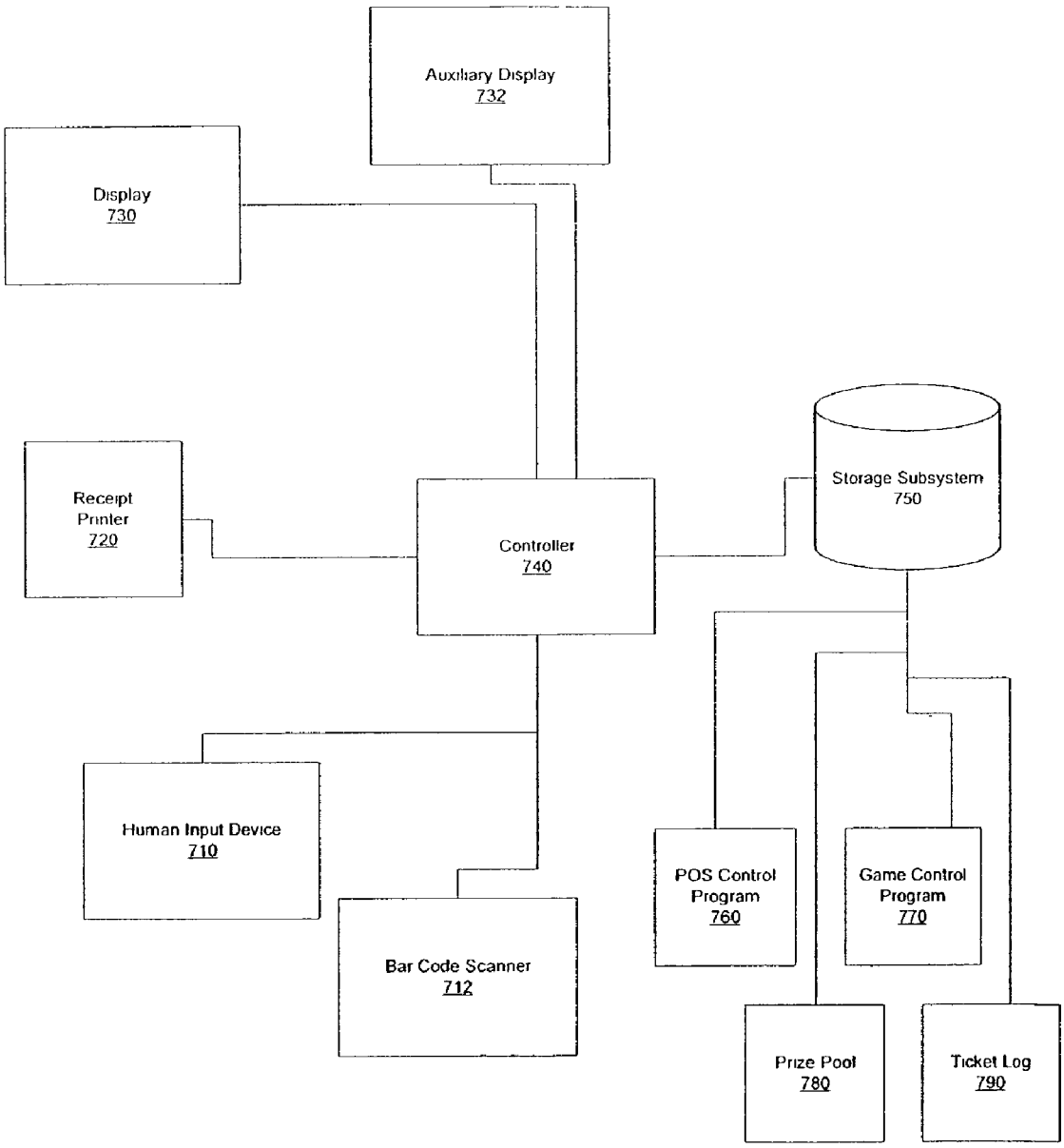
FIG. 7 illustrates a block diagram of an example point of sale terminal, according to an example embodiment of the present invention.
Figure 8:
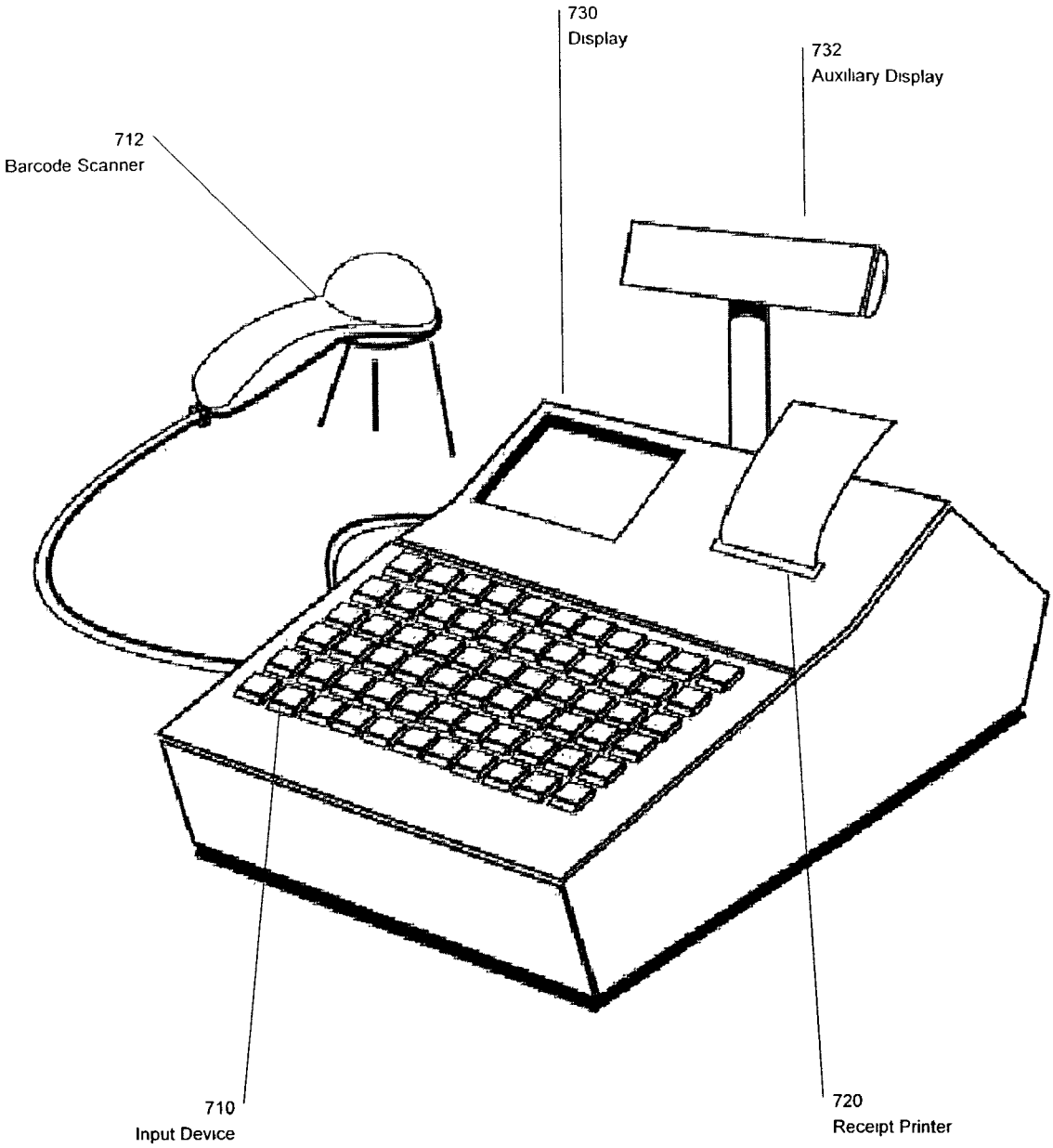
FIG. 8 illustrates an external physical view of the example point of sale terminal, according to an example embodiment of the present invention.

FIG. 7 illustrates a block diagram of an example point of sale terminal, according to an example embodiment of the present invention. FIG. 8 illustrates an external physical view of the example point of sale terminal, according to an example embodiment of the present invention. The example point of sale terminal may be configured for use with instant-win lottery tickets or other games. The example point of sale terminal may be a specialized "lottery-only" terminal or may also be configured to function as a conventional point of sale terminal, e.g., as a cash register for other merchandise.

The example point of sale terminal may include an input device 710. The input device may be configured to facilitate human input to the point of sale terminal. The input device may be a keyboard, keypad, touch screen, or other input device. Voice input may also be included, provided proper security measures are available. It will appreciated that different formats of input devices may be used in attended and automated point of sale terminals. The example point of sale terminal may include a barcode scanner 712. The barcode scanner may be replaced by any other suitable machine input device capable of inputting machine-readable information from a game ticket, e.g., a magnetic stripe scanner, a smart card reader, etc. The bar code scanner or other input device may be configured to read a machine-readable code, e.g., a bar code, from a first area on the instant-win lottery ticket not previously covered with a removable opaque coating, e.g., the code on the back of the ticket previously illustrated. This machine readable code may be read when a ticket is sold and used to activate the ticket. The input device may also be configured to read this code when the ticket is tendered for redemption. The input device may be further configured to read a second machine-readable code from the game play area on an instant-win lottery ticket when the lottery ticket is tendered for redemption. This game play area is the area that was previously covered with the removable opaque coating, such as a scratch-off layer. Both the machine readable codes may include authentication information, such as a numerical or symbolic code. The input device may be configured to transmit this information to the controller of the point of sale terminal, or alternatively, to transmit it directly to a central server or lottery database computer. It will be appreciated that the input device may operate automatically, e.g., in an unattended vending machine style terminal, or may be used by an attendant at a conventional lottery point of sale terminal, e.g., by swiping the ticket with a bar code scanning wand. Alternatively, an attended point of sale terminal may allow the ticket to be inserted into the machine and scanned automatically.

The example point of sale terminal may include a receipt printer 720. The receipt printer may be configured to print receipts for game ticket purchases and redemptions. In some applications, the receipt printer may be configured to print the game tickets themselves.

The example point of sale terminal may include a display 730. In an attended point of sale terminal this display may be configured to display information to the attendant. The example point of sale terminal may include an auxiliary display 732. In an attended point of sale terminal this may be configured to display information to a customer. In an unattended terminal a single display may replace the display and auxiliary display. In either application, the display may be any conventional display, e.g., LCD, CRT, or other display technology.

The example point of sale terminal may include a controller 740. The controller may be a microprocessor, single board computer, personal computer, or other type of controller.

The controller may be connected to the other components of the point of sale terminal via a bus, a network, or other form of connection that facilitates communication between the controller and other components of the point of sale terminal. The controller may be configured to direct the operations of the input and output devices, receiving information from the input devices and sending information for output to the output devices. The controller may be configured to have the output device prompt an attendant to scan one or more codes from a ticket, either to activate the ticket before sale, or to authenticate the ticket when tendered for redemption.

When a ticket is tendered for redemption, the controller may be configured to receive both authentication information read from the barcode scanner or other input device.

These pieces of authentication information may be obtained from at least two separate machine readable codes on the ticket, one previously under the scratch-off layer, and one not previously under the scratch off layer. The authentication information may be the machine readable codes, may be part of the machine readable codes, or may be determined using some predefined function of the machine readable codes, e.g., a concatenation of two codes. The controller may be further configured to authenticate the game ticket using at least both the first piece of authentication information and the second piece of authentication information. For example, this may be accomplished by using the authentication information, either separately or in combination as an index to look up the tendered ticket in a ticket database. For example, the two pieces of information may be concatenated or added together to form a single index for looking up the ticket in a ticket database or table. Alternatively, two separate authentication operations may be performed, one with each code, with the ticket ultimately being found valid only if both operations are successful. A third alternative is to perform a single validation operation, but to use the two pieces of information as successive indices into a two-level hash system or other table used for ticket validation.

If the controller finds that the ticket is a valid, e.g., when both pieces of authentication information are present and valid, and that the winning ticket that has not been previously redeemed, the controller may be further configured to signal the output device to output a message indicating that the game ticket should be redeemed. If the controller finds the ticket is invalid, a loser, or has been previously redeemed, the controller may be further configured to signal the output device to output a message indicating that the game ticket should not be redeemed.

The example point of sale terminal may include a storage subsystem 750. The storage subsystem may include RAM memory, flash memory, disk, CD-ROMS, or other forms of storage. The storage subsystem may be separate from or contained within the controller or another component of the point of sale terminal. The storage subsystem may be provided as a single unit, or as separate units for separate types of information needing storage.

The example point of sale terminal may include a POS control program 760 which may be stored in the storage subsystem. The POS control program may be configured to control conventional point of sale operations of the point of sale terminal, e.g., if the terminal is used for regular cash register sales operations or for the sales of other types of game tickets besides those described herein.

The example point of sale terminal may include a game control program 770 which may be stored in the storage subsystem. The game control program may be used to control game operations at the point of sale terminal, e.g., the sale, activation, authentication, and redemption of instant-win lottery tickets such as those illustrated previously.

The example point of sale terminal may include a prize pool 780 which may be stored in the storage subsystem. The prize pool may include information about the prizes associated with various tickets. This information may alternatively be stored in a central lottery computer or server, as will be described below.

The example point of sale terminal may include a ticket log 790 which may be stored in the storage subsystem. The ticket log may include information on which game tickets have been activated or sold, which have been redeemed, etc. An entry may be included in the ticket log for each ticket, or for each ticket that has been activated. The entries may be indexed by the authentication codes found on a ticket, or by some other approach. It will be appreciated that the ticket log and prize pool may be merged into a single file or database. It will also be appreciated that no particular data structure need be employed for the prize pool or database, provided information on tickets can be accurately and efficiently located. For example, arrays, relational databases, hash tables, or other data structures may all be employed.

It will be appreciated that the example point of sale terminal may be configured to perform operation needed to implement the example ticket sale, activation, authentication, and redemption procedures described previously. It will also be appreciated that some game control program operations may not be performed on the point of sale terminal, but instead may be performed by a server or central lottery database computer. In such case, the game control program or other program in the point of sale terminal may need to control the point of sale terminals interaction with the server or central lottery database computer, e.g., by sending and receiving information from the server or central lottery database computer.

Figure 9:
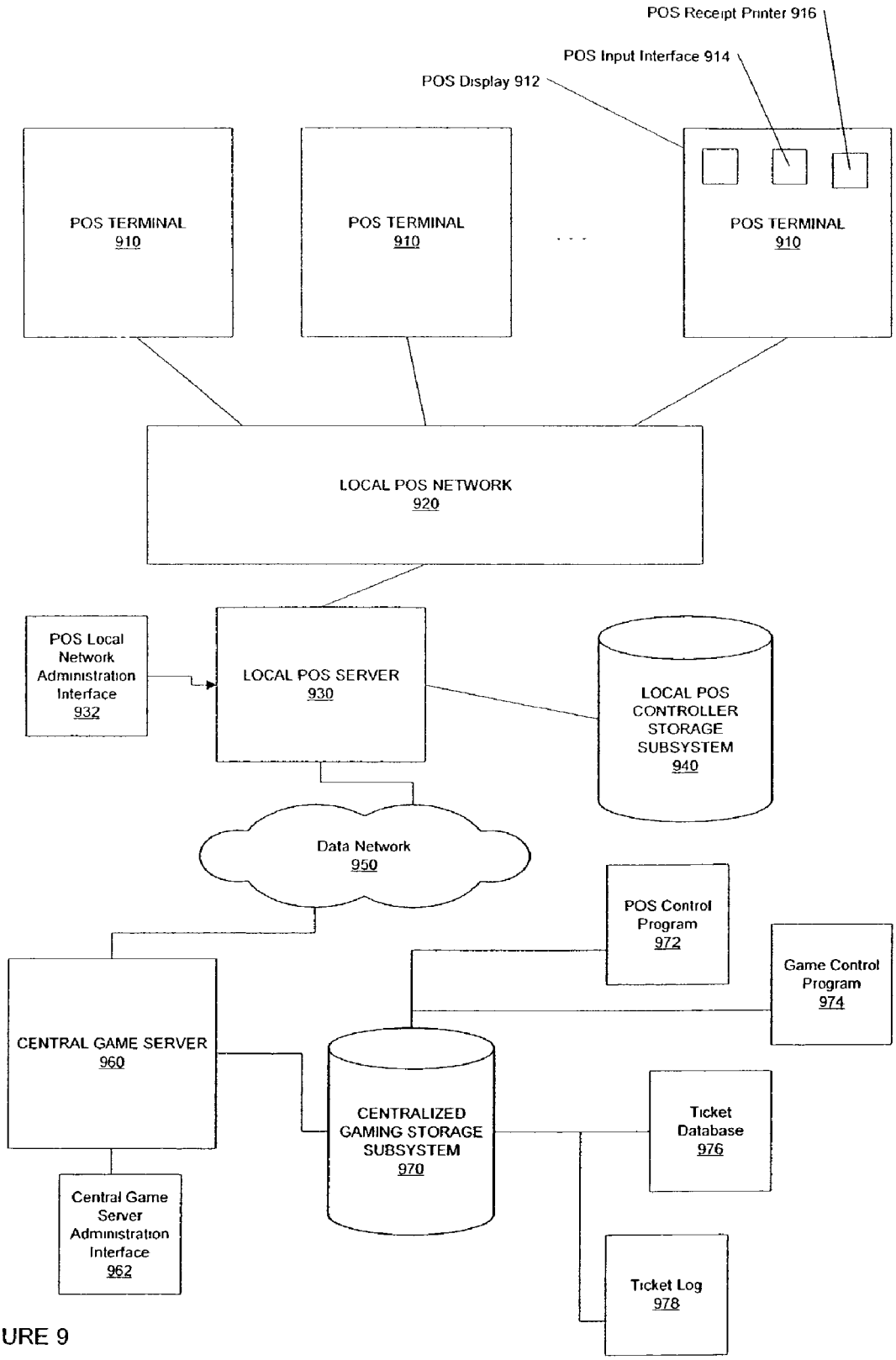
FIG. 9 illustrates an example distributed system for sale and redemption of game tickets, according to an alternative example embodiment of the present invention.

FIG. 9 illustrates an example distributed system for sale and redemption of game tickets, according to an example embodiment of the present invention.

The example distributed system may include one or more Point of Sale (POS) terminals 910. An example POS Terminal may include a display 912, an input interface 914, and a receipt printer 916. These POS terminals may be similar to the POS system described previously in FIGS. 8 and 9, although some of the control functions for game operations may be located outside the POS terminal, e.g., in the central game server or alternatively in a local POS server.

The POS terminals in a location or close to each other may be linked via a local POS network 920, e.g., a LAN such as an Ethernet or token ring. This POS network may but not include facilities for controlling the POS terminals. For example, a local POS server 930 may be connected to the POS terminals 910 via the local POS network 920 and may control normal POS operations, such as cash register operations, as well as providing communications with a central gaming database or server. The local POS server may include a local network administration interface 932, which may be provided as a terminal or other access method to the local POS server. This may be used to control local security, backups, and generally control conventional POS operations. The local POS server may also include a storage subsystem 940 for storing information needed to administer the local POS network and control conventional terminal operations.

The local POS server, and the POS terminals via the local POS server, may be connected to a data network 950. This data network may utilize the telephone network, the internet, or some other form of wide area networking. It will be appreciated that alternative arrangements may be employed, e.g., the local POS server may be omitted and the POS terminals may be connected directly to the network. The local POS server may provide other functions as well, e.g., encrypting and decrypting information before it is sent over the data network 950.

The example distributed system may include a central game server 960 which may be connected to the POS terminals and/or local POS server via the data network. The central game server may be administered through an administration interface 962. The central game server may include or be connected to a centralized gaming storage subsystem 970, which may be used to store information about gaming, such as tickets, game rules, information on sales, redemptions, etc. The centralized gaming storage subsystem may include copies of POS control programs 972 which may be downloaded to control local POS terminals, e.g., when changes in POS terminal operations are desired. The centralized gaming storage subsystem may also include game control programs 974 for controlling the central server's involvement in activation, authentication, and redemption of game tickets. The centralized gaming storage subsystem may also include a ticket database 976 and a ticket log 978. These two structures may be separate, or may be combined as part of a single database or file. The ticket database may include information on tickets and their associated prizes—e.g., which tickets are valid game tickets, which tickets are winners, and what the values of the winning tickets are. The ticket log may include information on whether, when, and where tickets have been activated, and on whether when and where tickets have been tendered for redemption. The central game server may be configured to look up tickets when information about the tickets is received, both to activate the tickets, and when redemption of the tickets is sought. For example, the controller may be configured to perform the operations described in the example ticket activation and authentication procedures described above.

It will be appreciated that the central game server may have include other capabilities, e.g., audit programs, accounting operations, additional security measures, etc. It will also be appreciated that any conventional data structure or storage method may be used for storing ticket information, e.g., relational databases, arrays, files, hash tables, etc.

In an alternative embodiment, the information for all tickets may be stored in the central computer and the information for a particular pack of tickets may be downloaded to the point of sale terminal when the pack of tickets is activated. This alternative approach, while potentially causing a slight reduction in security, may greatly increase the efficiency of ticket validation and redemption, because the point of sale terminal would not need to contact the central computer to validate every redeemed ticket. Other alternative distributions of information and processing may also be employed, e.g., some processing for tickets may be done on a local server, rather than on a point of sale terminal or at the central lottery server.

Figure 10A:
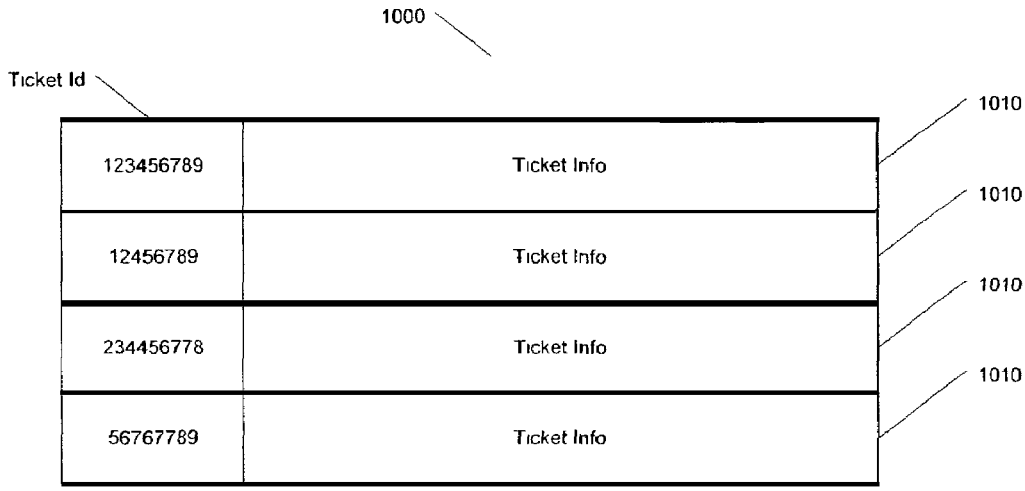
FIG. 10*a* illustrates an example ticket information table, according to an example embodiment of the present invention.

FIG. 10*a* illustrates an example ticket information table, according to an example embodiment of the present invention. The example table 1000 combines a ticket log and ticket prize database in a single data structure. It will be appreciated that the ticket log and ticket prize database may be stored separately, e.g., as separate tables in a relational database. It will also be appreciated that other data structures may be employed, e.g., a hash table, an array, linked list, or other conventional data structures. The example table 1000 may include entries 1010 for various tickets. The entries may be indexed by a ticket id, e.g., as a hash index into an array. The ticket id may be the authentication information found on a ticket, or some predetermined function of the authentication information. Alternatively, a separate ticket id field may be used, that is linked to the authentication information. Each entry may also include other information about the ticket with the corresponding ticket id.

Figure 10B:
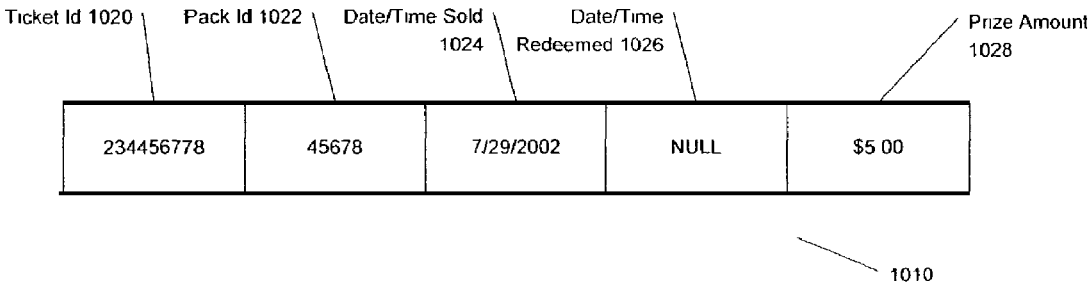
FIG. 10*b* illustrates an example entry in the example ticket information table of FIG. 10*a*, according to an example embodiment of the present invention.

FIG. 10*b* illustrates an example entry in the example ticket information table illustrated in FIG. 10*a*, according to an example embodiment of the present invention. Each entry may include various fields of information for a ticket. It will be appreciated that the various fields need not be stored in a single list or array, but may instead be stored using other arrangements, e.g., in separate normalized tables of a relational database, as a linked data structure, or in some other arrangement. The example entry 1010 may include a ticket id 1020. The ticket id 1020 may be the authentication information located on a ticket, e.g., the concatenation or sum of the two separate machine readable codes found on the ticket illustrated previously. Alternatively, the ticket id 1020 may be some other predetermined function of the authentication information found on the ticket, or may be a separate id field included on the ticket, or may be some other unique index.

The example entry 1010 may also include a pack id 1022. The pack id 1022 may identify the pack from which the ticket with ticket id 1020. The pack id 1022 may be in various forms, e.g., it may be a link to an entry in a pack information table, a numerical id, or some other format.

The example entry 1010 may also include a date/time sold field 1024. This entry may indicate the date and time the ticket was sold, which may be recorded when the ticket is activated if tickets are activated when sold. Any conventional date and time format may be employed.

The example entry 1010 may also include a date/time redeemed field 1026. Here the field is illustrated as NULL, indicating the ticket has not been redeemed. It will be appreciated that, alternatively, a separate flag may be employed to indicate whether the ticket has been redeemed.

The example entry 1010 may also include a prize amount 1028. Here the prize amount shown is $5.00. Any conventional format may be employed. Losing tickets may be included in the table with a "NULL" value. High value tickets may include a "DIVERT" flag in this field, or as a separate field, that indicates the customer should be instructed to go to a lottery service center for redemption.

It will be appreciated that other information may also be included in the ticket information table. For example, the selling price of a ticket may be included, e.g., if a fractional value ticket may be sold. Some tickets may also allow the purchaser to vary the odds by changing the amount spent. Information on this selection may also be included in the ticket information table entries. Information on where a ticket is redeemed may also be included.

MODIFICATIONS

In the preceding specification, the present invention has been described with reference to specific example embodiments thereof. It will, however, be evident that various modifications and changes may be made thereunto without departing from the broader spirit and scope of the present invention as set forth in the claims that follow. The specification and drawings are accordingly to be regarded in an illustrative rather than restrictive sense.

The invention claimed is:

1. An instant-win lottery game ticket having an associated pre-determined game outcome, comprising:

a substrate;

a game play area located on the substrate and visually indicating the associated pre-determined game outcome;

a first optically machine-readable code located separate and apart from the game play area on the substrate, the machine-readable code including a first piece of authentication information;

a second optically machine-readable code located on the substrate, the second machine-readable code including a second piece of authentication information;

a removable opaque covering applied to the substrate, the removable opaque covering concealing the game play area and the second machine-readable code; and wherein the first machine-readable code is not concealed by the removable opaque covering, and wherein both the first piece of authentication information and the second piece of authentication information are required for authenticating the game tickets, and wherein the associated pre-determined game outcome is independent of which portions of the removable opaque covering are removed from the game ticket.

2. The game ticket of claim 1, wherein the first piece of authentication information is different than the second piece of authentication information.

3. The game ticket of claim 1, wherein the removable opaque covering is a scratch-off layer.

4. The game ticket of claim 1, further comprising:

an indica located under the removable opaque covering and visually indicating whether the game ticket is a winning ticket.

5. The game ticket of claim 1, further comprising:

a first numeric code located on the substrate and not concealed by the removable opaque covering, the first numeric code containing information also included in the first machine-readable code.

6. The game ticket of claim 5, further comprising:

a second numeric code located on the substrate and concealed by the removable opaque covering, the second numeric code containing information also included in the second machine-readable code.

7. The game ticket of claim 1, wherein the first and second machine-readable codes are bar codes.

8. The game ticket of claim 7, wherein the first and second machine-readable codes are two-dimensional bar codes.

9. The game ticket of claim 1, further comprising:

game play data located on the substrate and concealed beneath the removable opaque coating; and a checking code separate from the game play data and concealed beneath the removable opaque covering, the checking code adapted to contain sufficient information to allow a determination that the game ticket is a winning ticket, the checking code lacking at least some of the information required for the authentication of the game ticket.

10. The game ticket of claim 9, wherein the checking code is machine-readable.

11. The game ticket of claim 9, wherein the checking code is included in the second machine-readable code.

12. The game ticket of claim 1, wherein the ticket has a front face and a reverse face, and wherein the first machine readable code is located on the reverse face of the ticket, and the second machine readable code is located on the front face of the ticket.

13. A method for validating an instant win lottery game ticket having a game play area covered by a removable opaque coating, comprising:

reading a first optically machine-readable code from a first area of the game ticket separate and apart from the game play area of the game ticket, the first area not having been previously covered with the removable opaque coating that has been subsequently removed, the first machine-readable code including a first piece of authentication information which is part but not all of the information required to validate the game ticket as a winning ticket;

reading a second optically machine-readable code from a second area of the game ticket, the second area having been previously covered with the removable opaque coating, the second machine-readable code including a second piece of authentication information which is part but not all of the information required to validate the game ticket as a winning ticket;

validating the game ticket using both the first and second pieces of authentication information, the validation being independent of which portions of the removable opaque covering were removed from the game ticket by a game player.

14. The method of validating a game ticket of claim 13, wherein the removable opaque covering is a scratch-off coating.

15. The method of validating a game ticket of claim 13, wherein the first machine-readable code is a bar code.

16. The method of validating an instant-win lottery ticket of claim 15 wherein the first machine-readable code is a two-dimensional bar code.

17. The method of validating an instant-win lottery ticket of claim 13, further comprising:

verifying that a different game ticket with the same authentication information as the game ticket has not been previously redeemed.

18. The method of validating a lottery ticket of claim 17, further comprising:

recording information indicating that the game ticket has been redeemed.

19. The method validating an instant-win lottery ticket of claim 16, wherein the game ticket further includes game play data located beneath the removable opaque covering, and the second machine-readable code further includes checking information adapted for determining whether the game ticket is a winning ticket, but that is separate from the game play data and is insufficient to validate the game ticket as a winning ticket.

20. The method of validating a game ticket of claim 13, further comprising:

receiving the game ticket, the first machine-readable code included in the first area of the game ticket , the first area not covered by the removable opaque coating, the second machine-readable code included in the second area of the game ticket, the second area covered by the removable opaque coating;

removing the removable opaque coating so that the second machine-readable code is exposed; and tendering the game ticket for redemption of a prize.

21. The method of validating a game ticket of claim 13, wherein the game ticket is an instant-win lottery ticket.

22. The method of claim 13, wherein the first piece of authentication information is different than the second piece of authentication information.

23. The method of claim 13, wherein the ticket has a front face and a reverse face, and wherein the first machine readable code is read from the reverse face of the ticket, and the second machine readable code is read from the front face of the ticket.

24. A system for redeeming an instant win lottery game ticket having a game play area covered with a removable opaque coating, comprising:

an input device configured to read a first optically machine-readable code from a first area on the instant-win lottery ticket separate and apart from the game play area and not previously covered with the removable opaque coating, the input device further configured to read a second optically machine-readable code from a second area on the instant-win lottery ticket previously covered with the removable opaque coating, the first machine-readable code including a first piece of authentication information for the game ticket and the second machine-readable code including a second piece of authentication information for the game ticket;

an output device; and a controller in communication with the input device and the output device, the controller configured to receive an at least one signal from the input device, the at least one signal including the first piece of authentication information and the second piece of authentication information, the controller further configured to authenticate the game ticket using at least both the first piece of authentication information and the second piece of authentication information, the authentication being independent of which portions of the removable opaque covering were removed from the game ticket by a game player, the controller further configured to signal the output device to output a message indicating that the game ticket should be redeemed if the controller has authenticated the game ticket, the controller further configured to signal the output device to output a message indicating that the game ticket should not be redeemed if the controller has not received both the first piece of authentication information and the second piece of authentication information.

25. The system for redeeming a game ticket of claim 24, wherein the input device is a bar code scanner.

26. The system for redeeming a game ticket of claim 24, wherein the controller, the input device, and the output device are located in a point of sale terminal.

27. The system for redeeming a game ticket of claim 24, further comprising:

a network providing a communication link between the controller and a point of sale terminal containing the input device and the output device.

28. The system for redeeming a game ticket of claim 24, further comprising:

a redeemed ticket log accessible to the controller.

29. The system for redeeming a game ticket of claim 28, wherein the redeemed ticket log includes an entry indicating whether any game ticket having the first and second pieces of authentication information has been tendered for redemption.

30. The system for redeeming a game ticket of claim 29, wherein the controller is configured to signal the output device to output a message indicating the game ticket should not be redeemed if the entry in the redeemed ticket log corresponding to the first and second pieces of authentication information indicates a game ticket having the first and second pieces of authentication information has been previously tendered for redemption.

31. The system of claim 24, wherein the first piece of authentication information is different than the second piece of authentication information.

32. The system of claim 24, wherein the ticket has a front face and a reverse face, and wherein the input device is further configured to read the first machine readable code from the reverse face of the ticket and the second machine readable code from the front face of the ticket.

33. An article of manufacture comprising a computer-readable medium having stored thereon instructions adapted to be executed by a processor, the instructions which, when executed by the processor, define a series of steps to be used to control a method for facilitating validation of an instant win lottery game ticket having a game play area covered by a removable opaque covering, the method comprising:

reading a first optically machine-readable code from a first area of the game ticket separate and apart from the game play area, the first area not having been previously covered with the removable opaque coating that has been subsequently removed, the first machine-readable code including a first piece of authentication information which is part but not all of the information required to validate the game ticket as a winning ticket;

reading a second optically machine-readable code from a second area of the game ticket, the second area having been previously covered with the removable opaque coating, the second machine-readable code including a second piece of authentication information which is part but not all of the information required to validate the game ticket as a winning ticket;

validating the game ticket using both the first and second pieces of authentication information, the validation being independent of which portions of the removable opaque covering were removed from the game ticket by a game player.

34. An article of manufacture comprising a computer-readable medium having stored thereon instructions adapted to be executed by a processor, the instructions which, when executed by the processor, define a series of steps to be used to control a method of validating an instant-win lottery ticket having a game play area covered by a removable opaque coating, the method comprising:

reading a first optically machine-readable code from a first area of the instant-win lottery ticket separate and apart from the game play area, the first area not having been previously covered with the removable opaque coating that has been subsequently removed, the first machine-readable code including a first piece of authentication information which is part but not all of the information required to validate the instant-win lottery ticket as a winning ticket;

reading a second optically machine-readable code from a second area of the instant-win lottery ticket, the second area having been previously covered with the removable opaque coating, the second machine-readable code including a second piece of authentication information which is part but not all of the information required to validate the instant-win lottery ticket as a winning ticket;

validating the instant-win lottery ticket using both the first and second pieces of authentication information, the validation being independent of which portions of the removable opaque covering were removed from the game ticket by a game player;

verifying that a different instant-win lottery ticket with the same authentication information as the instant-win lottery ticket has not been previously redeemed; and recording information indicating that the instant-win lottery ticket has been redeemed.

* * * * *